US007347732B2

(12) United States Patent
Ohtaka et al.

(10) Patent No.: US 7,347,732 B2
(45) Date of Patent: Mar. 25, 2008

(54) CONNECTOR

(75) Inventors: Kazuto Ohtaka, Makinohara (JP); Toshiharu Takahashi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/652,600

(22) Filed: Jan. 12, 2007

(65) Prior Publication Data

US 2007/0167088 A1 Jul. 19, 2007

(30) Foreign Application Priority Data

Jan. 13, 2006 (JP) ..... 2006-006414

(51) Int. Cl.
*H01R 13/40* (2006.01)

(52) U.S. Cl. ..... 439/595

(58) Field of Classification Search ..... 439/595, 439/752

See application file for complete search history.

(56) References Cited

U.S. PATENT DOCUMENTS 5,562,500 A * 10/1996 Tsukakoshi ..... 439/752

7,208,329 B2 * 4/2007 Fukatsu et al. ..... 438/14

FOREIGN PATENT DOCUMENTS

JP 2003-51352 A 2/2003

* cited by examiner

*Primary Examiner*—Khiem Nguyen
(74) *Attorney, Agent, or Firm*—Sughrue Mion, PLLC

(57) ABSTRACT

A temporary locking jig inserting hole which enables a retainer operating jig to be inserted thereinto from the outside is provided on a side of an inner housing of a female connector from which electric wires are drawn out in such a manner as to extend along a direction in which female terminals are inserted into the inner housing. In addition, a temporary locking retainer side tapered portion is provided on a retainer in such a manner as to correspond in position to the temporary locking jig inserting hole. In association with the insertion of the retainer operating jig from the temporary locking jig inserting hole, the temporary locking retainer side tapered portion is brought into sliding contact with a jig side tapered portion of the retainer operating jig, so as to displace the retainer which is being in a proper locking position to a temporary locking position.

11 Claims, 6 Drawing Sheets

CONNECTOR

BACKGROUND OF THE INVENTION

1. Field of the Invention

The present invention relates to a connector in which a terminal inserted into a connector housing is locked by a retainer.

2. Related Art

Conventionally, connectors have been known (refer to, for example, JP-A-2003-51352). FIG. 7 is a sectional view which shows a connector and a retainer operating jig which are disclosed in JP-A-2003-51352.

Referring to FIG. 7, in a connector, a retainer inserting opening 101 is provided in a female housing 100 in a direction (in FIG. 7, in a vertical direction) which intersects an inserting direction (in the figure, in a horizontal direction) of a female side terminal metallic fixture 110 at substantially right angles, and a retainer 120 is inserted from the relevant direction.

A jig inserting opening 102 is provided in an edge portion of the retainer inserting opening 101 along an inclined direction in such a manner as to communicate with an engagement hole 121 provided in the retainer 120. The jig inserting opening 102 makes a retainer operating jig 130 which is inserted therein reach the engagement hole 121 of the retainer 120. Namely, by being operated by making use of the principle of lever in such a state that the retainer operating jig 130 is inserted into the retainer hole 121 from the jig inserting opening 102 in the inclined direction, the retainer operating jig 130 displaces the retainer 120 from a proper locking position to a temporary locking position.

With the conventional connector structure shown in FIG. 7, however, when the connector structure is applied to a lever type connector or a connector in which a protection wall is provided outside a connector housing, the retainer inserting opening 101 and the jig inserting opening 102 in the female housing 100 are located inside a lever rotatably mounted on a connector housing of a female connector in the lever type connector or inside the protection wall provided outside the connector housing.

Because of this, the retainer operating jib 130 cannot be inserted into the jig inserting opening 102 and the engagement hole 121 of the retainer 120, leading to a problem that the cancellation of locking of the retainer 120 by the retainer operating jig 130 cannot be implemented without removing the lever of the lever type connector and the protection wall.

In addition, the retainer operating jig 130 is inserted from the jig inserting opening 102 in the female housing 100 into the engagement hole 121 in the retainer 120 in the inclined direction, so as to displace the retainer 120 to the temporary locking position by making use of the principle of lever. Because of this, in the event that the retainer operating jig 130 is operated more than required, there has been a possibility that the locking mechanism between the female housing 100 and the retainer 120, the jig inserting opening 102 of the female housing 100 and the engagement hole 121 of the retainer 120 fail.

Furthermore, the inserting direction of the retainer operating jig 130 into the jig inserting opening 102 in the female housing 100 and the engagement hole 121 in the retainer 120 is the inclined direction. Because of this, in order to perform a smooth and ensured operation, the construction and configuration of the retainer operating jig 130 need to be special, leading to a problem that the production costs are increased.

SUMMARY OF THE INVENTION

The invention was made in view of these situations, and an object thereof is to provide a connector which enables the cancellation of locking of the retainer by the retainer operating jig, obviates the necessity of operating the retainer operating jig more than required so as to prevent the failure or the like of the connector housing and the locking mechanism of the retainer, and furthermore, enables a smooth and ensured operation by the retainer operating jig without requiring a special construction and configuration for the retainer operating jig.

1) According to the invention, there is provided a connector including:

a retainer which enables a terminal to be inserted into a connector housing in a state that the retainer is locked in a temporary locking position in the connector housing and locks the terminal in a state that the retainer is displaced to a proper locking position, wherein a temporary locking jig inserting hole to which a retainer operating jig can be inserted is provided in the connector housing, and the retainer is displaceable from the proper locking position to the temporary locking position by the retainer operation jig that is inserted into the temporary locking jig inserting hole and is brought into to sliding contact with the retainer.

2) The retainer may include a temporary locking retainer side tapered portion which enables the retainer to be displaced from the proper locking position to the temporary locking position when the retainer operating jig is inserted.

According to the connector that is configured as has been described above, when operating to displace the retain from the proper locking position to the temporary locking position, the retainer operating jig is inserted from the temporary locking jig inserting hole in the connector housing. In association with the inserting operation of the retainer operating jig, the retainer which is being situated in the proper locking position is displaced to the temporary locking position. Consequently, the cancellation of locking of the retainer by the retainer operating jig can easily be implemented, and the retainer can be displaced from the proper locking position to the temporary locking position smoothly and in an ensured fashion without operating the retainer operating jig more than required.

In addition, since the retainer includes the temporary locking retainer side tapered portion, the retainer operating jig is brought into sliding contact with the temporary locking retainer side tapered portion, thereby making it possible to implement the displacement of the retainer from the proper locking position to the temporary locking position in the simple configuration and in an ensured fashion.

3) A proper locking jig inserting hole to which the retainer operating jig can be inserted maybe provided in the connector housing, and a proper locking retainer side tapered portion may be provided on the retainer which is adapted to displace the retainer which is situated in the temporary locking position to the proper locking position when the retainer operation jig is inserted to the proper locking jig inserting hole and is brought into sliding contact with the retainer.

According to the connector that is configured as has been described above, when operating to displace the retainer from the temporary locking position to the proper locking position, the retainer operating jig is inserted from the proper locking jig inserting hole in the connector housing. In association with the inserting operation of the retainer operating jig, the retainer operating jig is brought into sliding contact with the proper locking retainer side tapered portion on the retainer, whereby the retainer which is being situated in the temporary locking position is displaced to the proper locking position. Consequently, the displacement of the retainer from the proper locking position to the temporary locking position and the displacement of the retainer from the temporary locking position to the proper locking position by the retainer operating jig can easily be implemented.

According to the connector of the invention, there are obtained advantages that the cancellation of locking of the retainer by the retainer operating jig can be enabled, that the necessity of operating the retainer operating jig more than required is obviated, so as to prevent the failure or the like of the connector housing and the locking mechanism of the retainer, and furthermore that a smooth and ensured operation by the retainer operating jig can be implemented without requiring a special construction and configuration for the retainer operating jig.

BRIEF DESCRIPTION OF THE INVENTION

DETAILED DESCRIPTION OF THE PREFERRED EMBODIMENTS

Hereinafter, the invention will be described by reference to an embodiment which is illustrated in the accompanying drawings.

Figure 1:
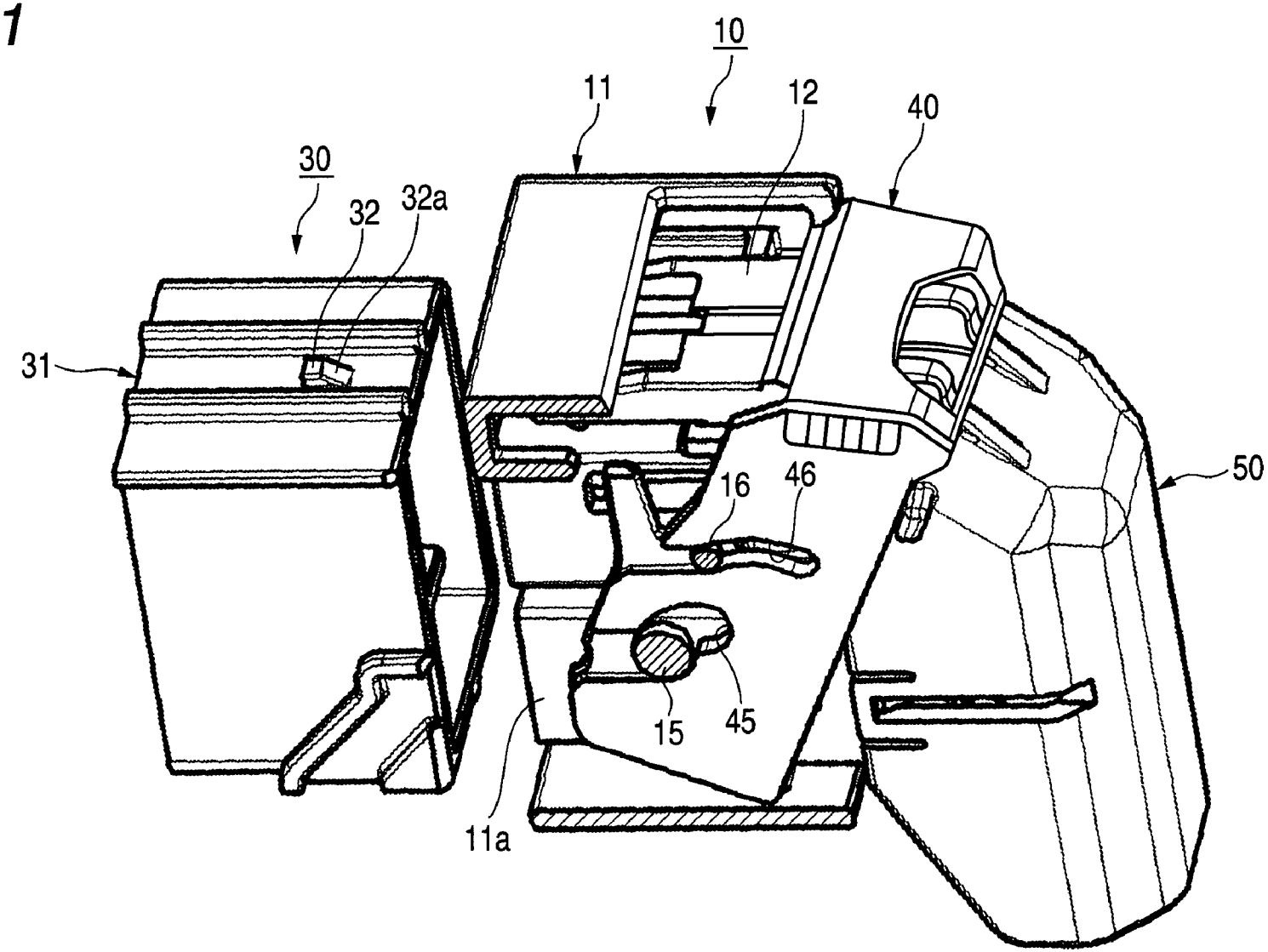
FIG. 1 is a perspective view of a connector structure of an embodiment of the invention with part of an outer housing removed therefrom which shows a state resulting before connectors are fitted together.
Figure 2:
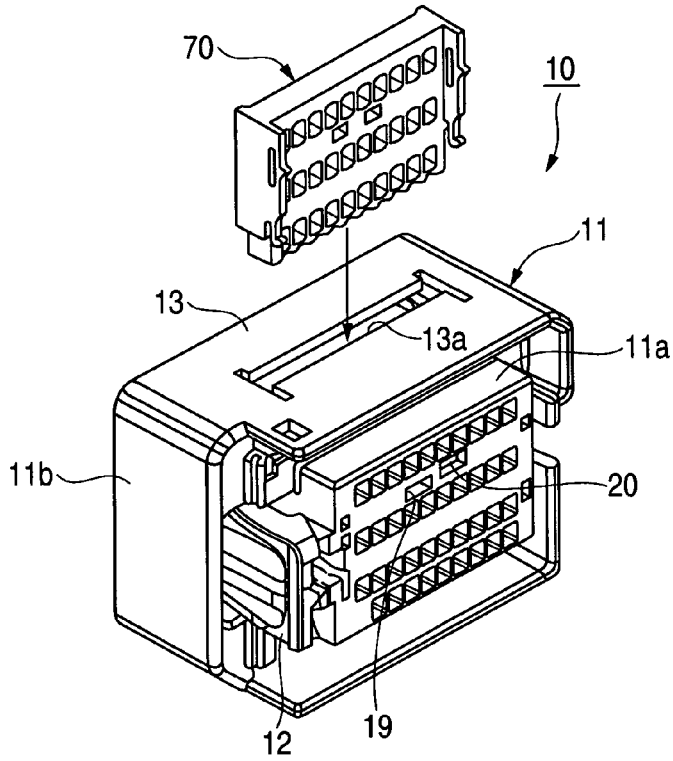
FIG. 2 is a perspective view of the connector structure in FIG. 1 which shows a state in which a retainer has not yet been assembled.
Figure 3:
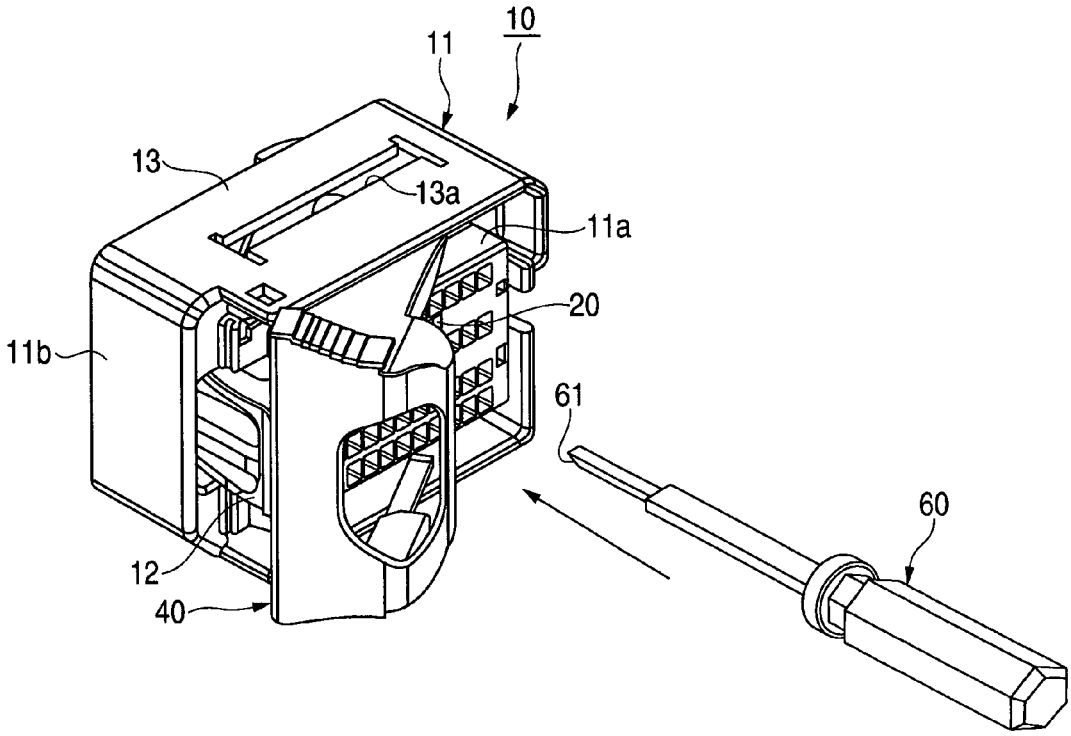
FIG. 3 is a perspective view of the connector structure shown in FIG. 1 which shows a state in which the retainer and a lever have been assembled with the lever located in a temporary locking position.
Figure 4:
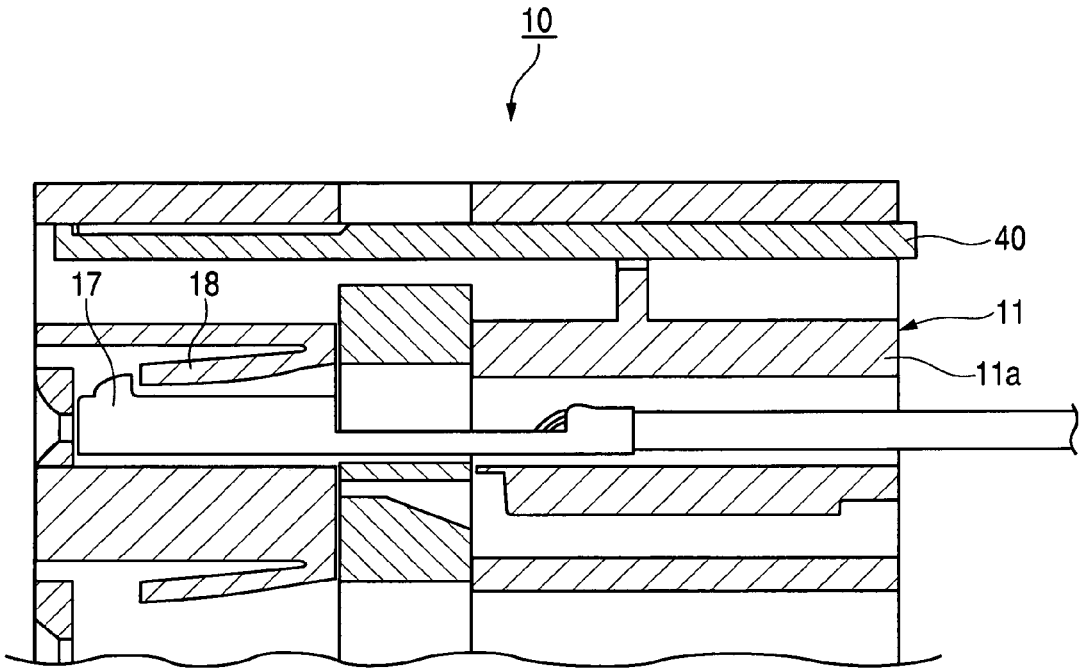
FIG. 4 is a sectional view showing a main part of the connector structure shown in FIG. 1.
Figure 5A:
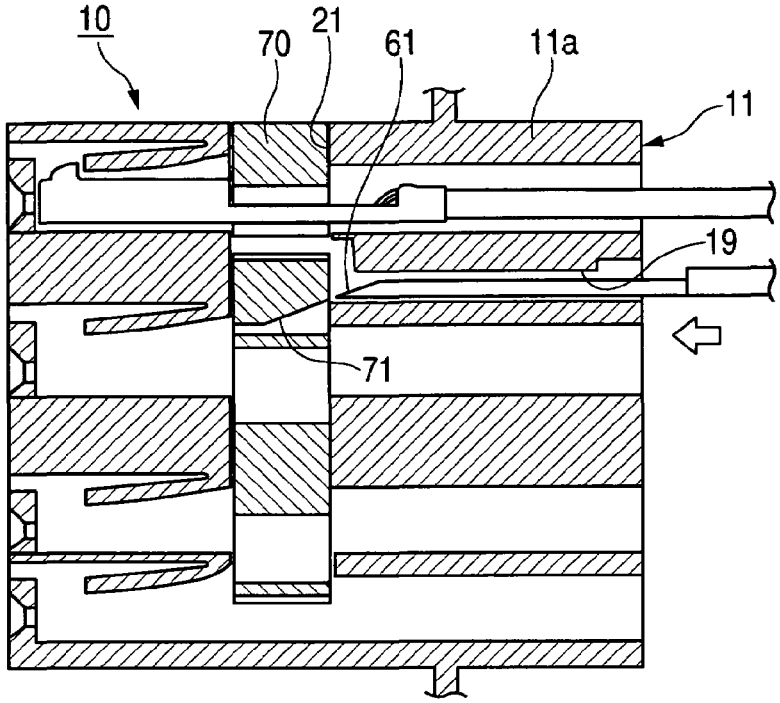
FIGS. 5A and 5B are schematic sectional views of the main part of the connector structure shown in FIG. 1 which show the periphery of a temporary locking jig inserting hole for explanation of a displacing operation of a retainer from a proper locking position to a temporary locking portion by a retainer operating jig.
Figure 5B:
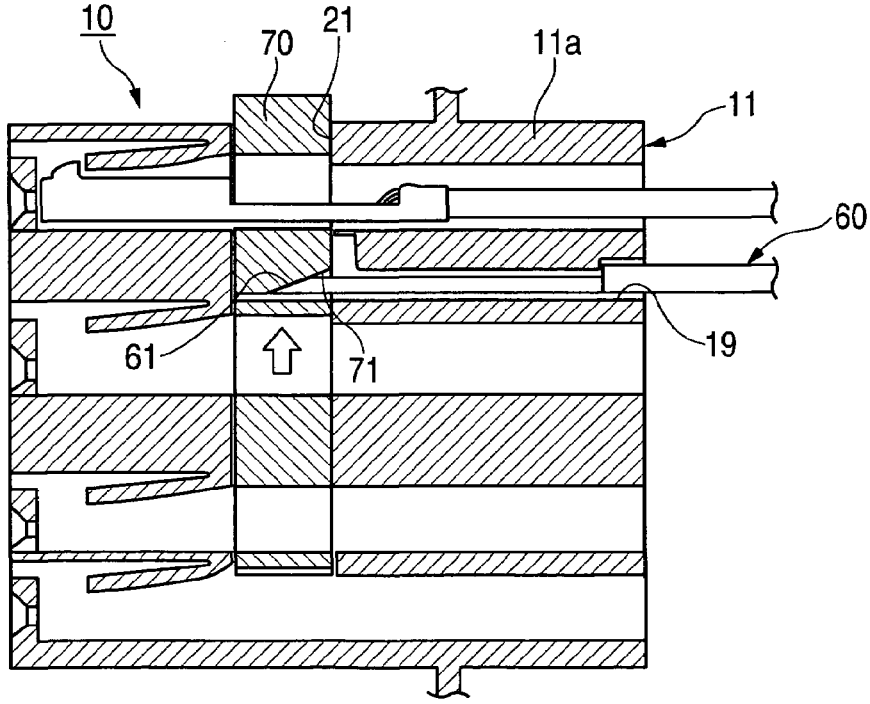
Figure 6A:
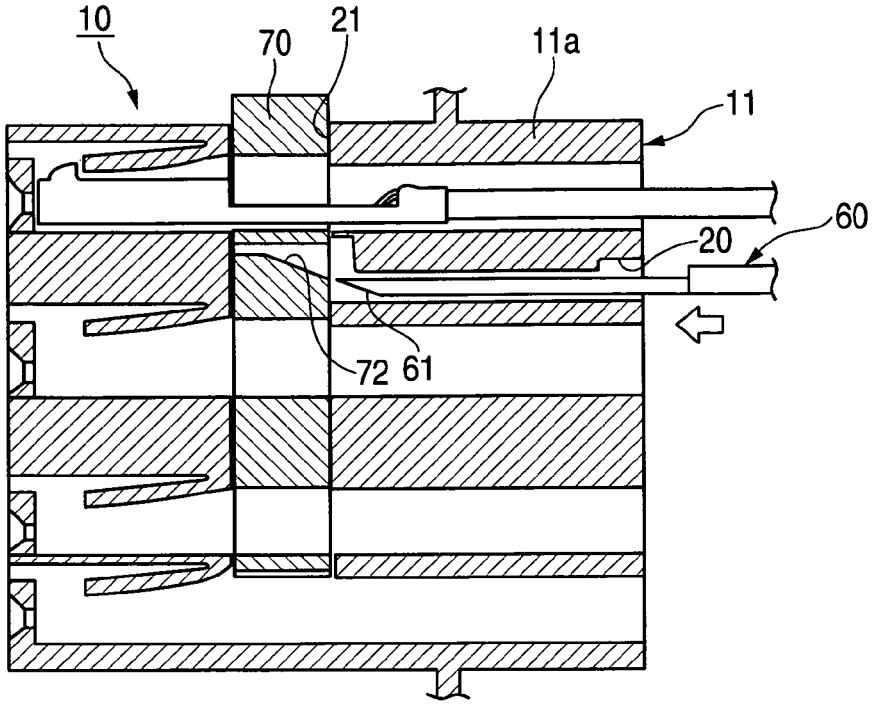
FIGS. 6A and 6B are schematic sectional views of the main part of the connector structure shown in FIG. 1 which show the periphery of a proper locking jig inserting hole for explanation of a displacing operation of the retainer from the temporary locking position to the proper locking portion by the retainer operating jig.
Figure 6B:
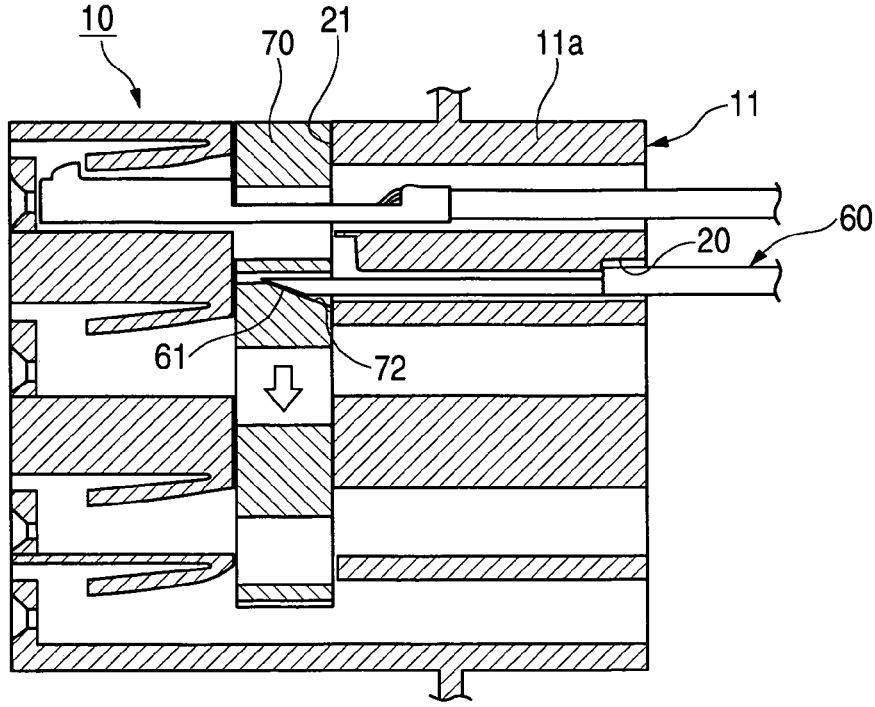
Figure 7:
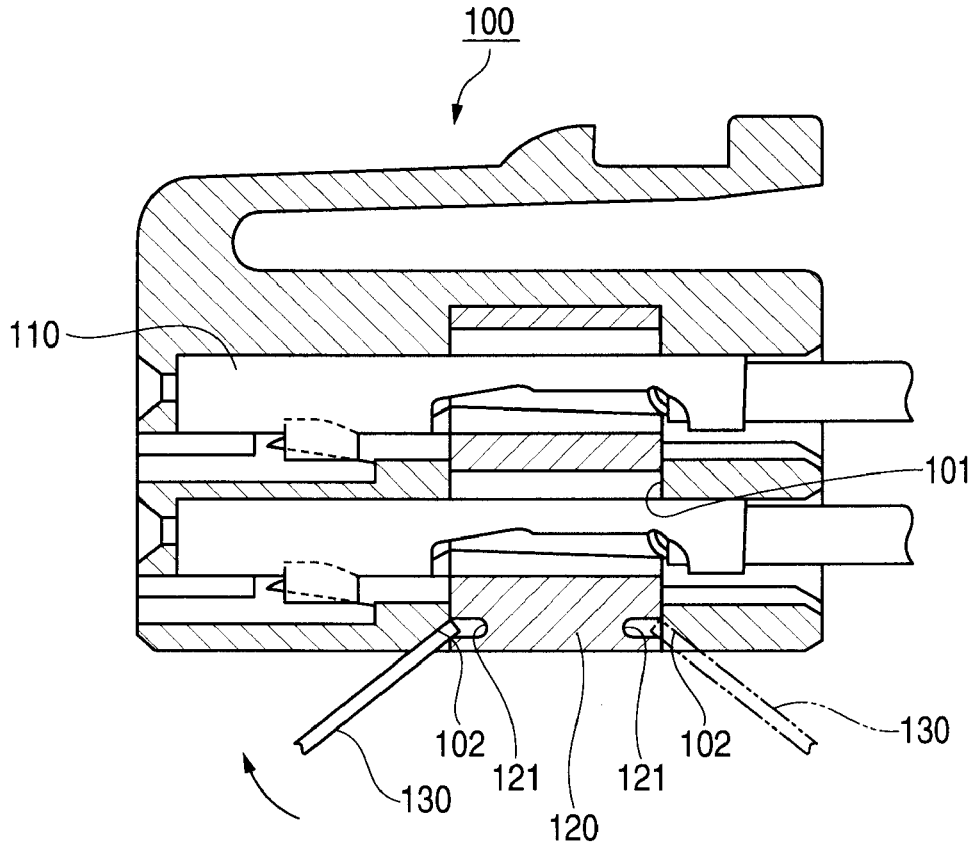
FIG. 7 PRIOR ART
FIG. 7 is a sectional view showing a connector and a retainer operating jig which are disclosed in JP-A-2003-51352.

FIG. 1 is a perspective view of a connector of an embodiment of the invention with part of an outer housing removed therefrom which shows a state resulting before connectors are fitted together, FIG. 2 is a perspective view showing the state in FIG. 1 in which a retainer has not yet been assembled, FIG. 3 is a perspective view showing the state in FIG. 1 in which the retainer and a lever have been assembled with the lever located in a temporary locking position, and FIG. 4 is a sectional view of a main part of FIG. 1. In addition, FIGS. 5A and 5B show schematic sectional views of the main part of the connector in FIG. 1 which show the periphery of a temporary locking jig inserting hole for explanation of a displacing operation of a retainer from a proper locking position to a temporary locking portion by a retainer operating jig, in which FIG. 5A shows a state in which the retainer is in the proper locking position, whereas FIG. 5B shows a state in which the retainer is displaced to the temporary locking position. Furthermore, FIGS. 6A and 6B show schematic sectional views of the main part of the connector in FIG. 1 which show the periphery of a proper locking jig inserting hole for explanation of a displacing operation of the retainer from the temporary locking position to the proper locking proportion by the retainer operating jig, in which FIG. 6A shows a state in which the retainer is in the temporary locking position, whereas FIG. 6B shows a state in which the retainer is displaced to the proper locking position.

Referring to FIGS. 1 and 2, a female connector 10 and a male connector 30 are fitted and locked together via a pair of female and male connector housings 11, 31 through engagement of an engagement portion (not shown) at a distal end of a locking arm 12 of the female connector 10 with an engagement projection 32 on the male connector 30. In addition, a fitting and locking operation and a fitting and locking canceling operation of the respective connector housings 11, 31 of the female and male connectors 10, 30 are implemented through rotating operations of a lever 40 which is rotatably mounted on an inner housing 11*a* of the female connector 10.

The female connector 10 has a double-wall construction in which the connector housing 11 thereof is made up of the inner housing 11*a* and an outer housing 11*b*. Terminal accommodating chambers are provided within the inner housing 11*a* of the female connector 10, and a plurality of female terminals 17 are accommodated in the terminal chambers. In addition, a locking arm 12 is provided on an external surface of the inner housing 11*a* of the female connector 10 in such a manner as to oscillate in a see-saw fashion about the vicinity of a longitudinal center thereof, and a cover 50, which protects electric wires which are laid to extend from a rear end side of the inner housing 11*a*, is fitted over the external surface of the inner housing 11*a*. In addition, an application point boss 15 which is provided on an internal surface of the outer housing 11*b* in such a manner as to project therefrom is fittingly passed through a fitting groove 45 in the lever 40 in such a manner as to slide therealong, and a lever rotation guide boss 16 which is provided on the internal surface of the outer housing lib in such a manner as to project therefrom is fittingly passed through a guide groove 46 in such a manner as to slide therealong.

The engagement portion of the locking arm 12 is brought into engagement with the engagement projection 32 of the male connector 30 in such a manner as to ride on a tapered portion 32*a* provided on the engagement projection 32 in association with the fitting of the male connector 30 in the female connector 10, and the respective connector housings 11, 31 of the connectors 10, 30 are fitted and locked together in such a state that the engagement portion has ridden over the engagement projection 3.

Referring to FIGS. 2 to 6B, the protection wall 13 is provided on the outer housing 11*b* of the female connector 10 in such a manner as to cover an external surface of the lever 40. The protection wall 13 protects the lever 40 and the locking arm 12. A retainer inserting opening 13*a* is opened in the protection wall 13, and a retainer 70 (to be described later on), which constitutes a secondary locking member for female terminals 17, is inserted into the retainer inserting opening 13*a*.

Lances 18, which constitute a primary locking member for female terminals 17, are provided in the inner housing 11*a* of the female connector 10. The lance 18 locks a female terminal 17 to the inner housing 11*a* of the female connector.

In addition, a temporary locking jig inserting hole 19 and a proper locking jig inserting hole 20 are provided on a side (a near side in FIGS. 2 and 3) of the inner housing 11*a* of the female connector 10 from which electric wires are drawn out or which is opposite to a side thereof from which the male connector 30 is fitted in the female connector 10 in such a manner as to extend along an inserting direction (a horizontal direction as viewed in FIG. 4) in which female terminals 17 are inserted into the inner housing 11*a* of the female connector 10.

The temporary locking jig inserting hole 19 allows a temporary locking retainer side tapered portion 71 (which will be described later on) to communicate with the outside, and a retainer operating jig 60 can be inserted thereinto from the outside. The temporary locking jig inserting hole 19 allows a jig side tapered portion 61 provided on the retainer operating jig 60 to be brought into sliding contact with the temporary locking retainer side tapered portion 71 on the retainer 70 in association with an inserting operation of the retainer operating jig 60.

The proper locking jig inserting hole 20 allows a proper locking retainer side tapered portion 72 (which will be described later on) to communicate with the outside, and the retainer operating jig 60 can be inserted thereinto from the outside. The proper locking jig inserting hole 19 allows the jig side tapered portion 61 on the retainer operating jig 60 to be brought into sliding contact with the proper locking retainer side tapered portion 72 on the retainer 70 in association with an inserting operation of the retainer operating jig 60.

Note that both the temporary locking jig inserting hole 19 and the proper locking jig inserting hole 20 can also be provided on the side (a far side as viewed in FIGS. 2 and 3) of the inner housing 11*a* of the female connector 10 from which the male connector 30 is fitted in the female connector 10. In addition, the temporary locking jig inserting hole 19 and the proper locking jig inserting hole 20, and the temporary locking retainer side tapered portion 71 and the proper locking retainer side tapered portion 72 do not have to be provided in such a manner as to extend along the inserting direction of female terminals 17, and hence, they can be provided in a direction which is at right angles to the inserting direction.

The retainer 70 is inserted from the retainer inserting opening 13*a* in the protection wall 13 on the outer housing 11*b* of the female connector 10 so as to be accommodated in a retainer accommodating portion 21 provided inside the inner housing 11*a* of the female connector 10. In the retainer accommodating portion 21, the retainer 70 allows female terminals 17 to be inserted into the inner housing 11*a* of the female terminal in such a state that the retainer 70 is locked in the predetermined temporary locking position (FIG. 5B and FIG. 6A) and allows the female terminals 17 to be locked to the inner housing 11*a* of the female connector 10 in such a state that the retainer 70 is displaced to the predetermined proper locking position (FIG. 5A and FIG. 6B), whereby the female terminals 17 are put in a double locked state in which the female terminals 17 are locked by the retainer 70 as well as the lances 18.

Note that in the event that the double locking of the female terminals 17 is not adopted, a configuration can be adopted in which the lances 18 are integrated with the retainer 70 so that the female terminals 17 are locked by the lances 18 at the time of temporary locking, whereas at the time of proper locking, the locking of the female terminals 17 by the lances 18 is canceled, and the female terminals 17 are locked by only the retainer 70.

The temporary locking retainer side tapered portion 71 and the proper locking retainer side tapered portion 72 are provided on the retainer 70 in such a manner as to correspond in position to the temporary locking jig inserting hole 19 and the proper locking jig inserting hole 20 in the inner housing 11*a* of the female connector 10, respectively.

Note that the temporary locking retainer side tapered portion 71 and the proper locking retainer side tapered portion 72 do not necessarily have to be provided, provided that the jig side tapered portion 61 is provided on the retainer operating jig 60. In addition, the jig side tapered portion 61 does not necessarily have to be provided, provided that the retainer side tapered portions 71, 72 are provided.

The temporary locking retainer side tapered portion 71 displaces the retainer 70 which is being in the proper locking position to the temporary locking position (from the state shown in FIG. 5A to the state shown in FIG. 5B) in association with the sliding contact thereof with the jig side tapered portion 61, which is in an upwardly oriented state as viewed in FIGS. 5A and 5B, of the retainer operating jig 60 which is inserted into the temporary locking jig inserting hole 19. Namely, the temporary locking retainer side tapered portion 71 displaces the retainer 70 from the proper locking position to the temporary locking position by virtue of the sliding contact with the jig side tapered portion 61 which occurs in association with the inserting operation of the retainer operating jig 60 from the temporary locking jig inserting hole 19, whereby the locking of the female terminals 17 by the retainer 70 is cancelled.

The proper locking retainer side tapered portion 72 displaces the retainer 70 which is being in the temporary locking position to the proper locking position (from the state shown in FIG. 5A to the state shown in FIG. 6B) in association with the sliding contact thereof with the jig side tapered portion 61, which is in a downwardly oriented state as viewed in FIGS. 6A and 6B, of the retainer operating jig 60 which is inserted into the proper locking jig inserting hole 20. Namely, the proper locking retainer side tapered portion 72 displaces the retainer 70 from the temporary locking position to the proper locking position by virtue of the sliding contact with the jig side tapered portion 61 which occurs in association with the inserting operation of the retainer operating jig 60 from the proper locking jig inserting hole 20, whereby the locking of the female terminals 17 by the retainer 70 is implemented.

Consequently, the retainer operating jig 60 can be inserted into the temporary locking jig inserting hole 19 or the proper locking jig inserting hole 20 in the inner housing 11*a* of the female connector 10 without being interrupted by the lever 40 or the protection wall 13, and hence, the lever 40 and the protection wall 13 do not have to be removed from the connector housing 11 of the female connector 10, whereby the cancellation of locking of the retainer 70 (from the proper locking position to the temporary locking position shown in FIGS. 5A and 5B) or the locking of the retainer 70 (from the temporary locking position to the proper locking position shown in FIGS. 6A and 6B) by the retainer operating jig 60 can be implemented within a short period of time smoothly and in an ensured fashion.

In addition, in association with the inserting operation of the retainer operating jig 60 into the temporary locking jig inserting hole 19 or the proper locking jig inserting hole 20 in the inner housing 11*a* of the female connector 10, the jig side tapered portion 61 is brought into sliding contact with the temporary locking retainer side tapered portion 71 or the proper locking retainer side tapered portion 72 of the retainer 70, so that the retainer operating jig 60 displaces the retainer 70 by a predetermined amount in the predetermined directions.

Consequently, the retainer 70 can be displaced to the temporary locking position or the proper locking position by the simple operation in which the retainer operating jig 60 is only inserted into the temporary locking jig inserting hole 19 or the proper locking jig inserting hole 20, and hence, there is no risk that the retainer operating jig 60 is operated more than required, whereby the failure or the like of the connector housing 11 of the female connector 10 and the locking mechanism of the retainer 70 can be prevented in an ensured fashion. Furthermore, the construction and configuration of the retainer operating jig 60 do not have to be special, and hence, a smooth and ensured position control of the retainer 70 by the retainer operating jig 60 can be realized at low costs.

The connector that is obtained by the invention is preferably applied to a case in which the cancellation of locking of the retainer (from the proper locking position to the temporary locking position) or the locking of the retainer (from the temporary locking position to the proper locking position) by the retainer operating jig is wanted to be implemented within a short period of time smoothly and in an ensured fashion.

What is claimed is:

1. A connector comprising:

a retainer which enables a terminal to be inserted into a connector housing in a state that the retainer is locked in a temporary locking position in the connector housing and locks the terminal in a state that the retainer is displaced to a proper locking position, wherein a temporary locking jig inserting hole to which a retainer operating jig can be inserted is provided in the connector housing, and the retainer is displaceable from the proper locking position to the temporary locking position by the retainer operation jig that is inserted into the temporary locking jig inserting hole and is brought into to sliding contact with the retainer;

wherein a proper locking jig inserting hole to which the retainer operating jig can be inserted is provided in the connector housing, and the retainer is displaceable from the temporary locking position to the proper locking position when the retainer operation jig is inserted into the proper locking jig inserting hole and is brought into sliding contact with the retainer.

2. The connector according to claim 1, wherein the retainer includes a temporary locking retainer side tapered portion which enables the retainer to be displaced from the proper locking position to the temporary locking position when the retainer operating jig is inserted.

3. The connector according to claim 1, wherein the retainer includes a proper locking retainer side tapered portion which enables the retainer to be displaced to the proper locking position from the temporary locking position when the retainer operating jig is inserted.

4. The connector according to claim 2, wherein the retainer includes a proper locking retainer side tapered portion which enables the retainer to be displaced to the proper locking position from the temporary locking position when the retainer operating jig is inserted.

5. The connector according to claim 1, wherein the temporary locking jig inserting hole and the proper locking jig inserting hole are provided at a same side of the connector housing.

6. The connector according to claim 4, wherein the temporary locking jig inserting hole and the proper locking jig inserting hole are provided at a same side of the connector housing.

7. The connector according to claim 1, wherein the temporary locking jig inserting hole is configured such that the retainer is displaceable to the temporary locking position by contact with the retainer when the retainer operating jig is inserted in a longitudinal direction of the temporary locking jig inserting hole.

8. The connector according to claim 7, wherein the proper locking jig inserting hole is configured such that the retainer is displaceable to the proper locking position by contact with the retainer when the retainer operating jig is inserted in a longitudinal direction of the proper locking jig inserting hole.

9. The connector according to claim 5, wherein the temporary locking jig inserting hole and the proper locking jig inserting hole extend in a direction orthogonal to the same side of the connector housing.

10. The connector according to claim 9, wherein the temporary locking jig inserting hole is configured such that the retainer is displaceable to the temporary locking position by contact with the retainer when the retainer operating jig is inserted in a longitudinal direction of the temporary locking jig inserting hole.

11. The connector according to claim 10, wherein the proper locking jig inserting hole is configured such that the retainer is displaceable to the proper locking position by contact with the retainer when the retainer operating jig is inserted in a longitudinal direction of the proper locking jig inserting hole.

* * * * *